US009437977B1

(12) United States Patent
Belack et al.

(10) Patent No.: US 9,437,977 B1
(45) Date of Patent: Sep. 6, 2016

(54) GROUNDING AND RETENTION MEMBER

(71) Applicant: TYCO ELECTRONICS CORPORATION, Berwyn, PA (US)

(72) Inventors: Dustin Carson Belack, Hummelstown, PA (US); Kyle Gary Annis, Hummelstown, PA (US); Kevin Michael Thackston, York, PA (US); Brent David Yohn, Newport, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/640,466

(22) Filed: Mar. 6, 2015

(51) Int. Cl.
*H01R 4/66* (2006.01)
*H01R 13/648* (2006.01)
*H01R 43/16* (2006.01)

(52) U.S. Cl.
CPC ..... *H01R 13/648* (2013.01); *H01R 43/16* (2013.01)

(58) Field of Classification Search
CPC ..... H01R 13/648
USPC ..... 439/95
See application file for complete search history.

(56) References Cited

U.S. PATENT DOCUMENTS 3,397,384 A * 8/1968 Lawrence ..... H01R 31/02 439/246
3,456,231 A * 7/1969 Zimmerman, Jr. .... H01R 13/20 439/516
3,475,720 A * 10/1969 Culver ..... H01R 13/426 439/744
3,569,915 A * 3/1971 Sorensen ..... H01R 13/7197 333/182
3,670,292 A * 6/1972 Tracy ..... H01R 13/65802 439/607.12
3,697,935 A * 10/1972 Drapkin ..... H01R 31/00 439/724
4,241,976 A * 12/1980 Oliver ..... H01R 13/426 29/458
4,362,350 A * 12/1982 von Harz ..... H01R 13/426 439/607.12
4,659,163 A * 4/1987 Althouse ..... H01R 13/719 439/607.25
4,854,899 A * 8/1989 Matthews ..... H01R 31/02 439/724
4,936,795 A * 6/1990 Kawai ..... H01R 13/655 439/607.19
5,052,948 A * 10/1991 Hyzin ..... H01R 13/65802 29/874
5,108,312 A * 4/1992 Sampson ..... H01R 12/7052 439/567
5,192,216 A * 3/1993 Knauber ..... H01R 13/65802 439/108
5,192,233 A * 3/1993 Suffredini ..... H01R 9/2483 439/723
5,286,210 A * 2/1994 Kilsdonk ..... H01R 13/514 439/638
5,346,403 A * 9/1994 Hyzin ..... H01R 13/65802 439/95
5,356,316 A * 10/1994 Anderson ..... H01R 9/2408 439/724

(Continued)

*Primary Examiner* — Tulsidas C Patel
*Assistant Examiner* — Peter G Leigh

(57) ABSTRACT

A grounding and retention member which includes a plate having openings positioned therein. First contact and retention projections extend from proximate edges of the plate. The first contact and retention projections cooperate with a shell of the connector to provide an electrical connection between the plate and the shell of the connector. Second contact and retention projections extend from proximate edges of at least one of the openings. The second contact and retention projections cooperate to retain contacts in contact receiving passageways of a connector and to provide an electrical connection between the contacts and the plate.

11 Claims, 7 Drawing Sheets

(56) References Cited

U.S. PATENT DOCUMENTS 5,752,854 A * 5/1998 Capp ..... H01R 13/743 439/607.28
5,885,103 A * 3/1999 Ernolf ..... H01R 13/65802 439/246
6,095,862 A * 8/2000 Doye ..... H01R 13/65802 439/138
6,739,882 B2 * 5/2004 Fuehrer ..... H01R 13/502 439/347
6,857,882 B2 * 2/2005 Van Den Meersschaut .... H01R 13/65802 439/607.01
7,553,201 B2 * 6/2009 Imai ..... H01R 13/73 439/108
7,641,516 B1 * 1/2010 Scott ..... H01R 13/2471 439/607.12
7,736,199 B2 * 6/2010 Cossette ..... H01R 13/426 439/745
8,690,585 B2 * 4/2014 An ..... H01R 13/41 439/66
2002/0031946 A1 * 3/2002 Kim ..... H01R 13/6633 439/620.07

* cited by examiner

GROUNDING AND RETENTION MEMBER

FIELD OF THE INVENTION

The present invention is directed to a grounding member for grounding electrical contacts, the grounding member having retention members integral therewith which cooperate with the contacts to retain the contacts in a housing of an electrical connector.

BACKGROUND OF THE INVENTION

Aeronautical Radio, Inc. ("ARINC") is a commercial standards group governing connectors, connector sizes, rack and panel configurations, etc, primarily for airborne applications. Connectors which conform to ARINC specifications are sometimes referred to as ARINC connectors. One example of an ARINC connector is the ARINC 600 Quadrax connector that receives Quadrax contacts therein. The Quadrax contact is a multi-signal contact system employing two differential pairs used with quad-axial cables for databus applications on commercial aircraft. In addition to commercial avionics, aircraft data networks and in-flight entertainment systems, the Quadrax contacts and connectors can be used in military networking and communications as well as multi-gigabit applications. The Quadrax contact consists of four contacts arranged within a shell having an envelope defined according to ARINC standards. Typically, the Quadrax contacts include an insulative body having four channels for receiving the four contacts. The insulative body is received within a metallic or metalized plastic outer shell. The Quadrax contacts are mounted and retained in connectors which are configured based on the particular application. The connectors may contain one or more Quadrax contacts and may include contacts which are not Quadrax contacts. In addition, the connectors may be different shapes, including, but not limited to, circular or rectangular. A Quadrax style connector that receives the Quadrax contacts is typically metal or metalized plastic.

In order to properly maintain the Quadrax style contacts in the connector, retention clips may be provided which are received in contact receiving passages of the connector. Each retention clip engages a respective Quadrax pin contact to maintain the respective Quadrax pin contact in a respective contact receiving passage. This type of retention is not limited to Quadrax connectors, but is used for many styles of contacts. In such applications, the shell of each contact engages its respective retention clip and the respective retention clip engages the wall of the contact receiving passage. As the wall of the contact receiving passage is typically metal or metalized plastic, a grounding path is provided between the shell of the contact and the wall of the contact receiving passage. Alternatively, a grounding plate, such as that shown in U.S. Pat. No. 4,808,118 may be provided to extend across much of the width of the connector and make contact with the shell of the connector. In such applications, each contact and/or the clip may engage the grounding plate to facilitate the grounding of the contact to the connector. However, in either embodiment, the grounding connection is not assured as the connection between the clip and the wall or between the clip and the grounding plate must rely on gravity or tight tolerances to ensure that a proper electrical connection is effected and maintained. As it is difficult and expensive to tightly control tolerances and as oxides or other contaminants may accumulate between mating surface, the effectiveness of the grounding connection may not be adequate.

It would therefore be beneficial to provide a cost effective, reliable grounding connection between the contacts and the shell of the connector. It would also be beneficial to provide a grounding member which incorporates retention clips, thereby eliminating individual parts while ensuring that the contacts are properly maintained in the contact receiving passageway and properly grounded to the shell of the connector. Such a grounding and retention member would be advantageous for ARINC Quadrax connectors as well as many other connectors in which contacts are arranged in contact receiving cavities.

SUMMARY OF THE INVENTION

An embodiment is directed to a grounding and retention member which includes a plate having openings positioned therein. First contact and retention projections extend from proximate edges of the plate. The first contact and retention projections cooperate with a shell of the connector to provide an electrical connection between the plate and the shell of the connector. Second contact and retention projections extend from proximate edges of at least one of the openings. The second contact and retention projections cooperate to retain contacts in contact receiving passageways of a connector and to provide an electrical connection between the contacts and the plate.

An embodiment is directed to a connector for housing a plurality of contacts therein. The connector a non-conductive housing, a conductive outer shell and a grounding and retention member. The non-conductive housing has a plurality of contact receiving passageways. The conductive outer shell is proximate the non-conductive housing. The grounding and retention member has openings positioned therein. The openings are aligned with the contact receiving passageways. The grounding plate includes first contact and retention projections and second contact and retention projections. The first contact and retention projections extend from proximate edges of the grounding and retention member. The first contact and retention projections cooperate with the shell of the connector to provide an electrical connection between the grounding and retention member and the shell. The second contact and retention projections extending from proximate edges of the openings. The second contact and retention projections cooperate to retain the contacts in the contact receiving passageways and to provide an electrical connection between the contacts and the grounding and retention member.

An embodiment is directed to a method of manufacturing a grounding member comprising: stamping a plate from conductive material; stamping openings in the plate; forming at least one retention member from the material stamped for at least one of the openings, the at least one retention member formed proximate edges of the at least one of the openings; and forming resilient arms proximate edges of the plate.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
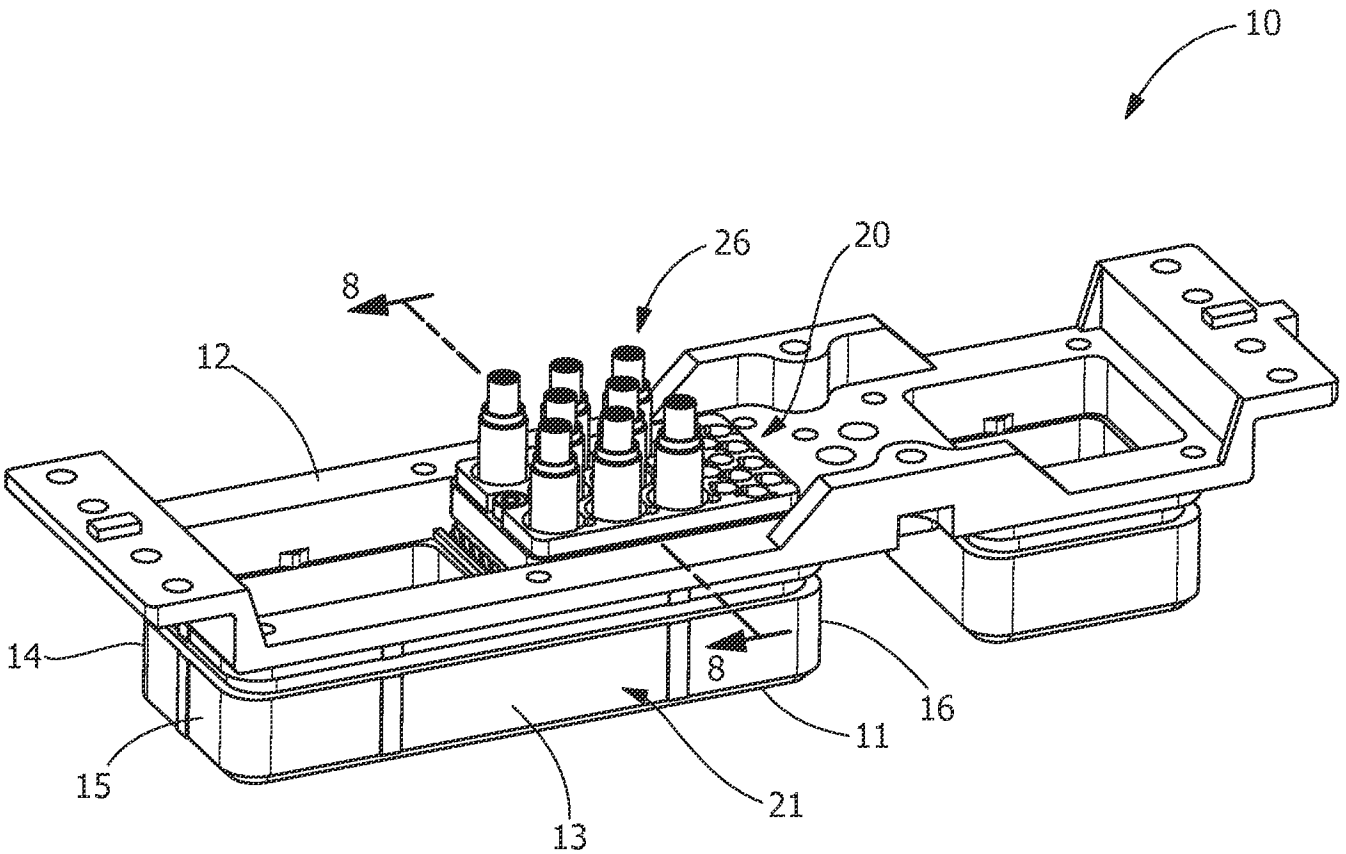
FIG. 1 is a perspective view of an illustrative connector assembly.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

In general, the invention is directed to a grounding and retention member which provides a cost effective, reliable grounding and retention connection between contacts and a shell of a connector. The grounding and retention member cooperates with the contacts to ensure that the contacts are properly maintained in the contact receiving passageway and properly grounded to the shell of the connector.

Figure 2:
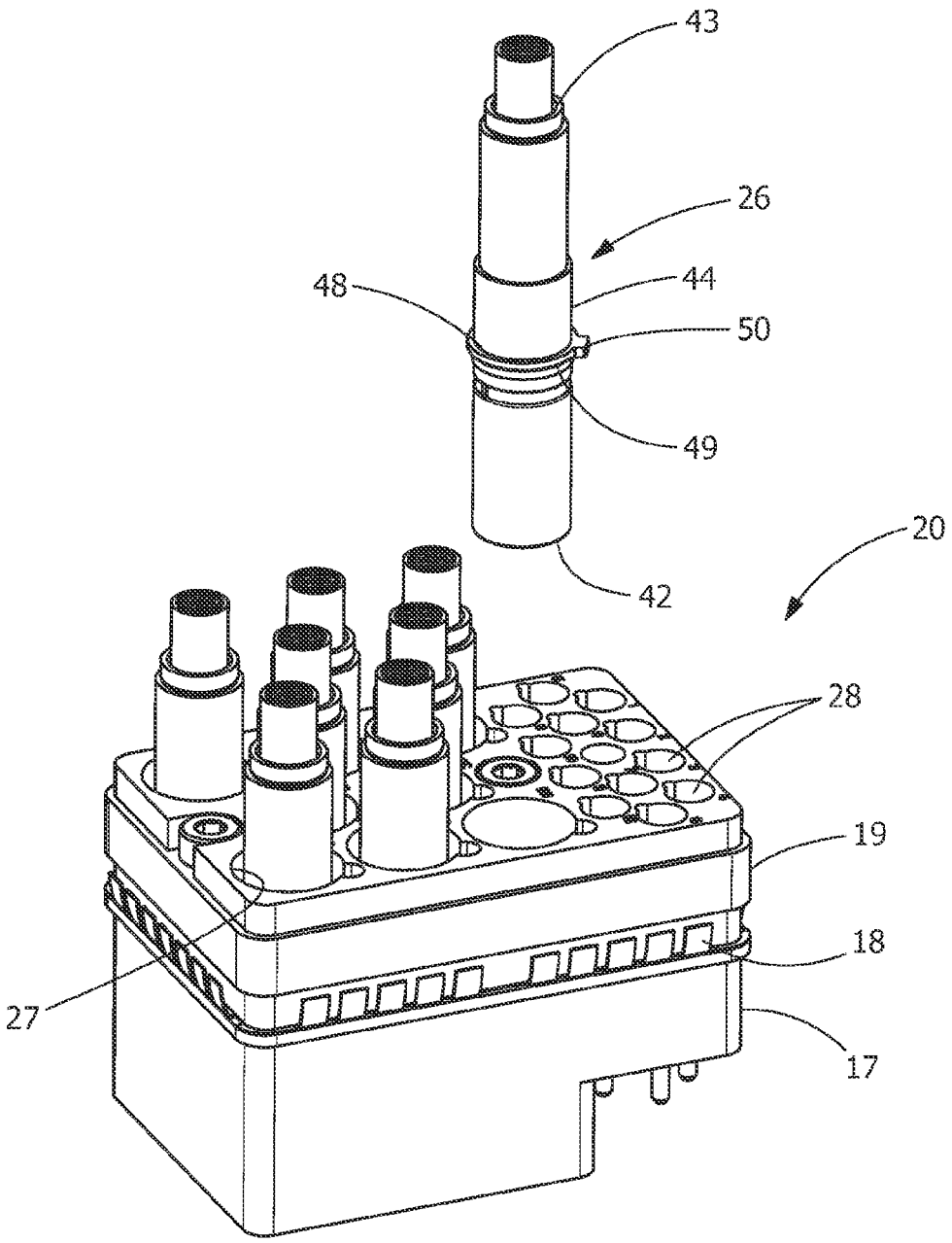
FIG. 2 is a perspective view of the connector assembly of FIG. 1 with the conductive shell removed and an illustrative contact exploded therefrom.
Figure 3:
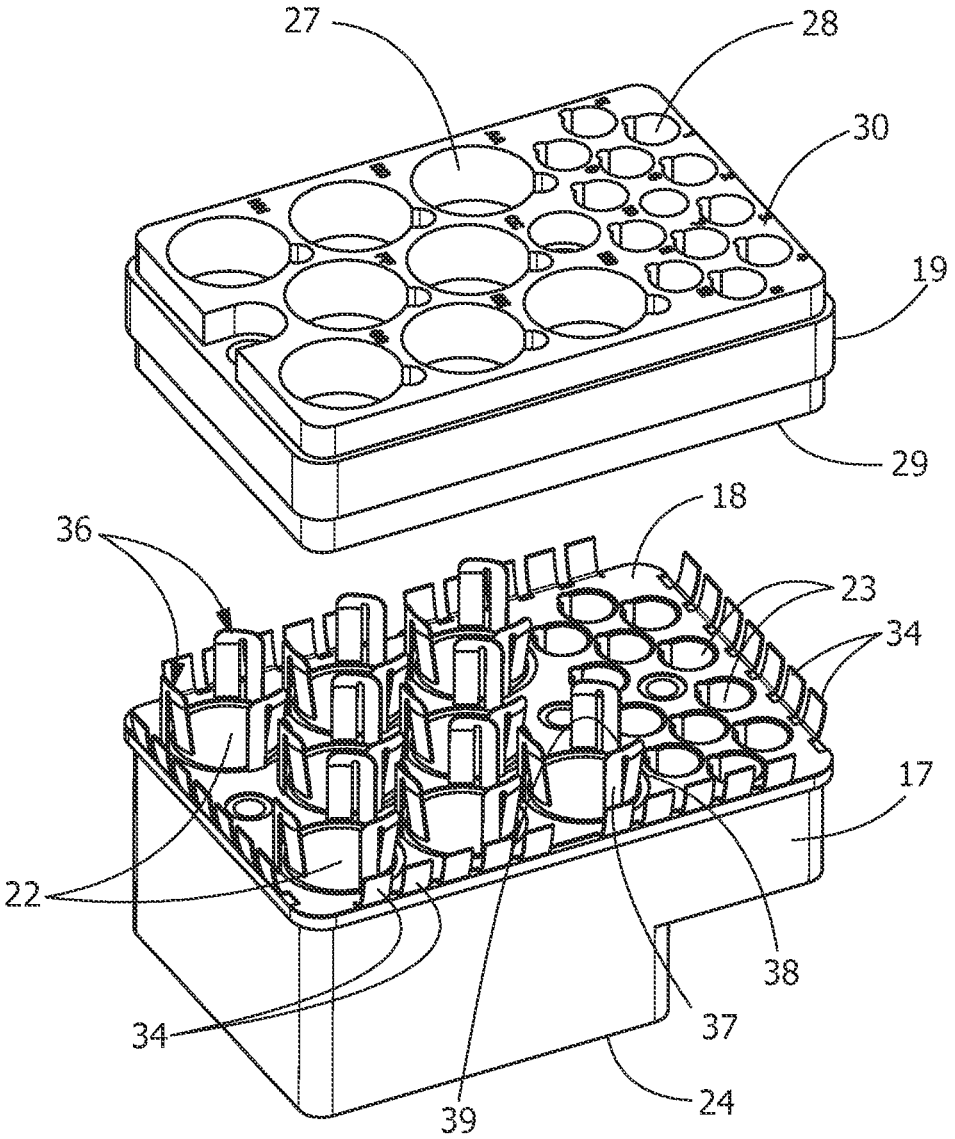
FIG. 3 is a perspective view of the connector subassembly of FIG. 2 with the contacts removed, an illustrate grounding and retention member according to the present invention is shown attached to a housing with an insert exploded therefrom.
Figure 4:
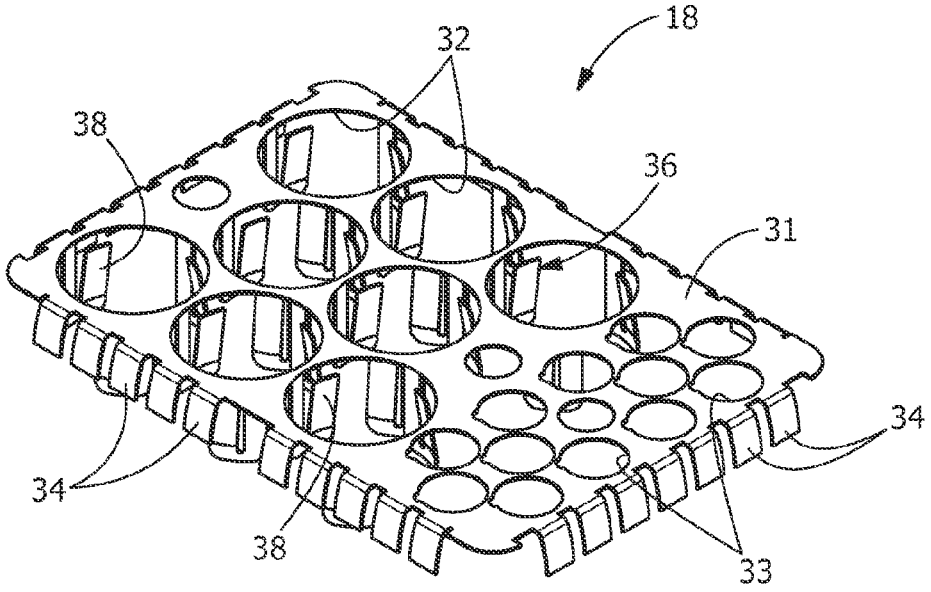
FIG. 4 is a top perspective view of the grounding and retention member of FIG. 3.

Referring to FIG. 1, an illustrative electrical connector 10 is shown. The illustrative connector 10 has a rectangular configuration with a front wall 11, a rear wall 12, side walls 13, 14 and end walls 15, 16. The front wall 11, rear wall 12, side walls 13, 14 and end walls 15, 16 are made from metal, metalized material or other conductive material to form a conductive shell 21. As best shown in FIGS. 2 and 3, the connector 10 includes a housing 17, a grounding and retention plate or member 18, and an insert 19. The housing 17, grounding and retention member 18 and insert 19 are mounted or bonded together to form a housing subassembly 20 which is retained in the shell 21 (FIG. 1). In the illustrative embodiment, the housing 17, member 18 and insert 19 are glued together, although other known methods of bonding or mounting may be used. The housing 17 and insert 19 are made from plastic or other non-conductive material having the strength requirements needed to maintain the positioning of the contacts. The grounding and retention member 18 is made from metal, metalized material or other conductive material.

The housing 17 has contact receiving passageways 22, 23 which extend from a front wall 24 of the housing 17 to a rear wall 25 of the housing 17 (as best shown in FIG. 3). In the embodiment shown, contact receiving passageways 22 have a larger diameter than contact receiving passageway 23, thereby allowing larger contacts 26 to be inserted into contact receiving passageways 22 than the contacts (not shown) which are inserted into contact receiving passageways 23. The contacts 26 may be, but are not limited to, ARINC Quadrax contacts.

The insert 19 has contact receiving passageways 27, 28 which extend from a front wall 29 of the insert 19 to a rear wall 30 of the insert. In the embodiment shown, contact receiving passageways 27 have a larger diameter than contact receiving passageway 28, thereby allowing larger contacts 26 to be inserted into contact receiving passageways 27 than the contacts (not shown) which are inserted into contact receiving passageways 28. The diameters of the contact receiving passageways 27 of the insert 19 are larger than the diameters of the contact receiving passageways 22 of the housing 17 and align with the contact receiving passageways 22 of the housing 17 when the insert 19 and housing are properly positioned. Similarly, the diameters of the contact receiving passageways 28 of the insert 19 are larger than the diameters of the contact receiving passageways 23 of the housing 17 and align with the contact receiving passageways 23 of the housing 17 when the insert 19 and housing are properly positioned.

Although contact receiving passageways 22, 23, 27, 28 and contact 26 are shown, other configuration of the housing 17 and insert 19 may be used without departing from the claimed invention. For example, housing 17 and insert 19 may only have one size contact receiving passageway and one size contact. Alternatively, housing 17 and insert 19 may have three or more different sizes of contact receiving passageways and contacts.

The grounding and retention member 18 as best shown in FIGS. 4 through 7, includes a plate 31 with openings 32, 33 extending therethrough. In the illustrative embodiment shown, the openings 32, 33 have diameters which are similar to the diameters of contact receiving passageways 22, 23 respectively. Consequently, although openings 32, 33 are shown, other configuration of the grounding and retention member 18 may be used without departing from the claimed invention. For example, grounding and retention member 18 may only have one diameter size opening. Alternatively, grounding and retention member 18 may have three or more different diameter sizes of openings.

The grounding and retention member 18 is dimensioned to be positioned between the rear wall 25 of the housing 17 and the front wall 29 of the insert 19. In this position, the openings 32, 33 align with respective passageways 22, 23 of the housing 17 and respective passageways 27, 28 of the insert 19.

Figure 8:
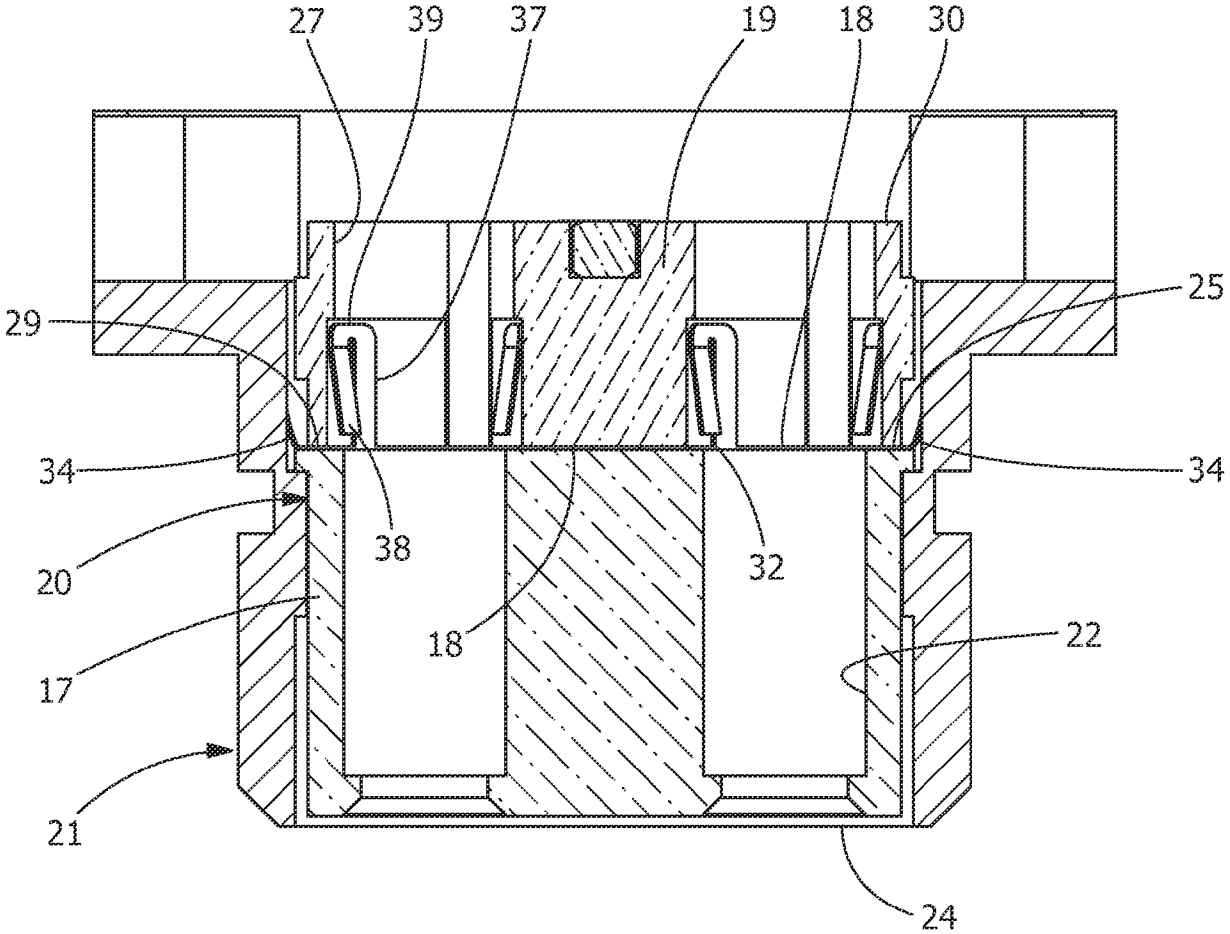
FIG. 8 is a cross-sectional view taken along line 8-8 of FIG. 1, illustrating the connector subassembly fully inserted into a shell, with the grounding and retention member in electrical engagement with the shell of the connector.

First grounding and retention projections or resilient retention and contact arms 34 extend from member 18 about the perimeter thereof. In the embodiment shown, the contact arms 34 extend about all four sides of the plate 31 of the member 18. The contact arms 34 are stamped and bent to form an angle of between 45 degrees and 90 degrees to a first surface 35 of the member 18. In the embodiment shown, the contact arms 34 are formed as multiple independent arms with each having resilient characteristics. However, other configurations may be used without departing from the scope of the invention. As shown in FIGS. 2, 3 and 8, the contact arms 34 are formed to extend beyond the sidewalls of the housing 17 and the insert 19 when the housing 17 and insert 19 are assembled to the grounding and retention member 18.

Figure 5:
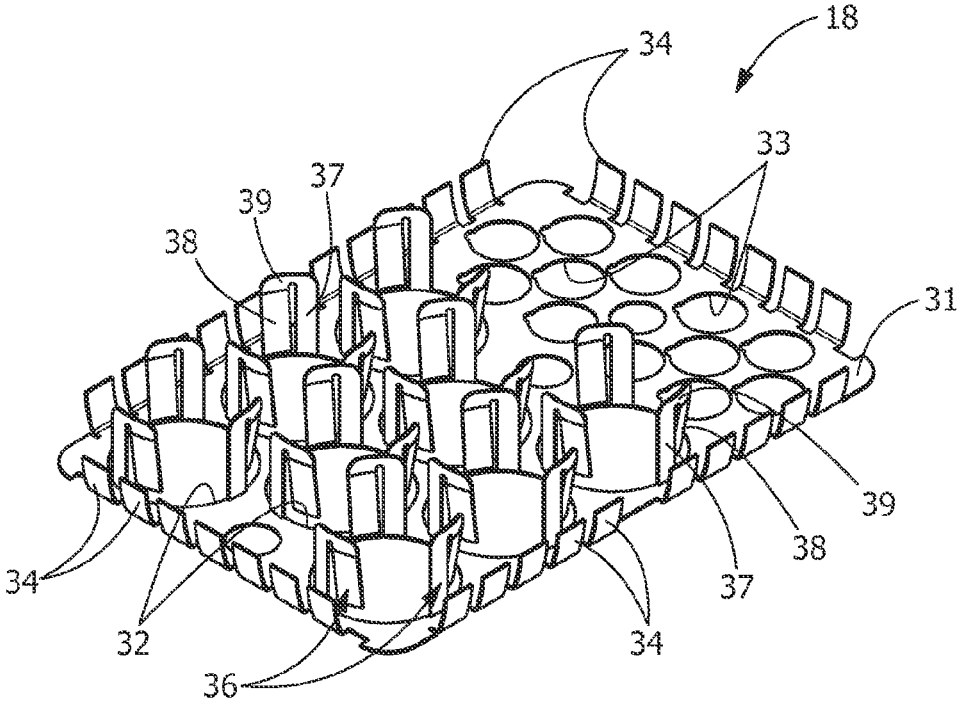
FIG. 5 is a bottom perspective view of the grounding and retention member of FIG. 4.
Figure 6:
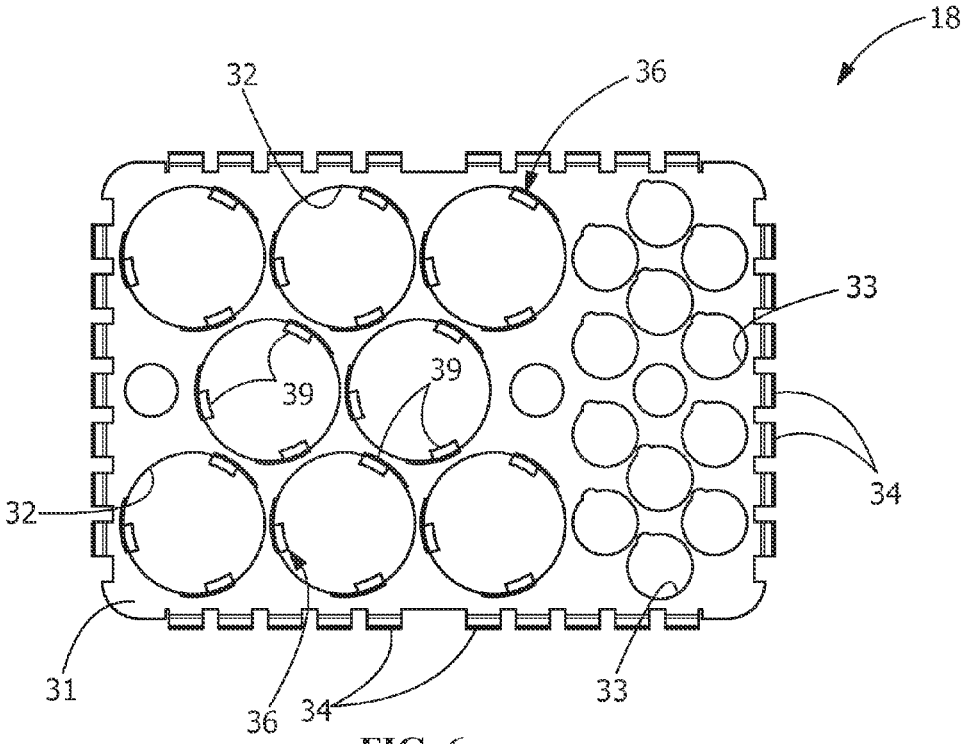
FIG. 6 is a top plan view of the grounding and retention member of FIG. 4.
Figure 7:
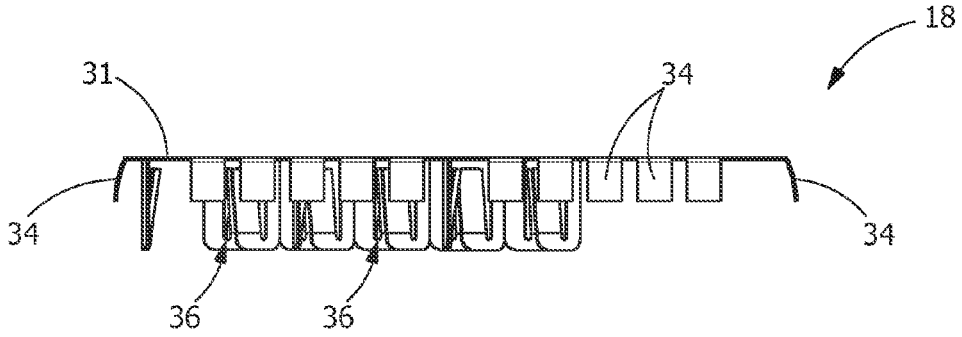
FIG. 7 is a side plan view of the grounding and retention member of FIG. 4.

Second resilient grounding and retention projections 36 extend from the circumference of openings 32, as best shown in FIGS. 3, 5 and 8. In the illustrative embodiment shown, the resilient retention and contact projections 36 are stamped and formed from the material of the member 18 which is removed to form the openings 32. Each resilient retention and contact projection 36 has a mounting leg 37, a retention leg 38 and a U-shaped member 39 which attaches the retention leg 38 to the mounting leg 37. The retention leg 38 is elastically bent or formed to extend into opening 32 a greater distance than mounting leg 37 (as best shown in FIGS. 6 and 8). A locking shoulder 40 is provided at the free end of the retention leg 38. The configuration of the mounting leg 37, retention leg 38 and the U-shaped member 39 allows the retention leg 38 to elastically deform when the contact 26 is inserted into passageway 24, as will be more fully described. In the embodiment shown, three resilient retention and contact projections 36 are provided about the circumference of each opening 32. However, other number of resilient retention and contact projections 36 may be provided without departing from the scope of the invention.

Figure 9:
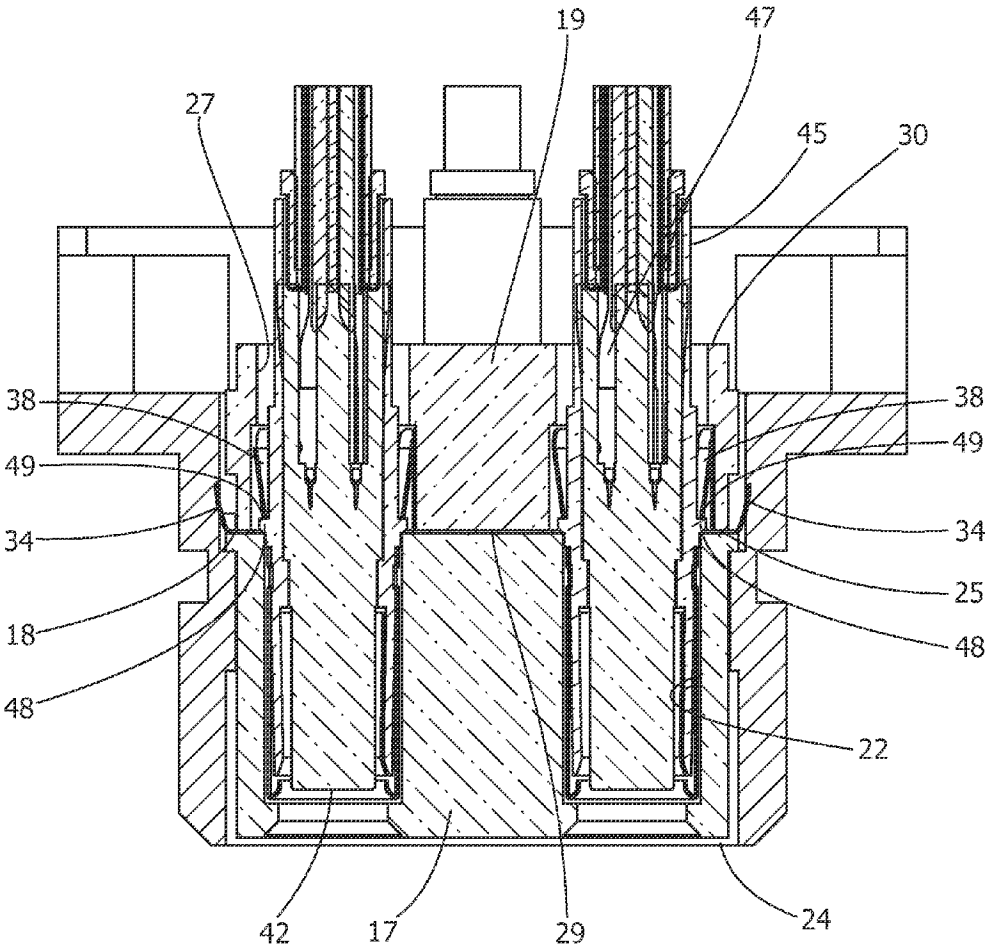
FIG. 9 is a cross-sectional view similar to FIG. 8, illustrating contacts fully inserted into contact receiving passageways, with the grounding and retention member in electrical engagement with the shell of the connector and the contacts.

Referring to FIG. 2, each contact 26 has a mating end 42 and a wire receiving end 43. A mounting portion 44 is provided between the mating end 42 and the wire receiving end 43. The mounting portion 44 is formed of metal or other material having electrically conductive characteristics. As shown in FIG. 9, upon insertion of the contact 26 in the contact receiving passageways 23, 27 the mating end 42 is positioned in the contact receiving passageway 23 proximate the front wall 24 of the housing 17. The wire receiving end 43 extends from the rear wall 30 of the insert 19. The mounting portion 44 is positioned in the contact receiving passageway 27. In one illustrative embodiment, each contact 26 has a metal or metalized shell 45 which houses individual pins 47 therein. However, other types of contacts can be used without departing from the scope of the invention. A shoulder 48 is provided about the circumference of the contact 26. The shoulder 48 is on the mounting portion 44. In the embodiment shown, the shoulder 48 is provided on a projection 49 which extends from the shell of the contact 26. However, in other illustrative embodiments, the shoulder 48 may be provided on a transition between portions of the shell which have different diameters. A keying or orientation member 50 is provided on the contact 26 proximate the projection 49.

During assembly, the housing 17, member 18 and insert 19 are affixed together as described above to form the subassembly 20. The subassembly 20 is positioned in the shell 21 and is retained therein between the walls of the shell 21. As the subassembly 21 is inserted into the shell 21, the resilient retention and contact arms 34 engage the shell 21 and are slightly bent or resiliently deformed by the insertion. This causes the resilient retention and contact arms 34 to be biased against the shell 21. This bias continues as the subassembly 21 is fully inserted in the shell 21, thereby providing a secure and maintainable electrical connection between the shell 21 and the grounding and retention member 18.

Contacts 26 are inserted into the connector 10 and subassembly 20 through the rear wall 12 of the connector 10 and the rear wall 30 of insert 19. The insertion of contacts 26 continues until projection 49 of the mounting portion 44 engages the rear wall 25 of the housing 17, thereby preventing further insertion of the contacts 26 into the subassembly 20. As the diameter of passageways 22 are smaller than the diameters of passageways 27, the projections 49 of contacts 26 can be freely inserted into passageways 27. However, as the diameter of projections 49 is larger than the diameter of the passageways 22, the continued insertion of the contacts 26 is prevented when the projections 49 engage or contact the portions of the rear wall 25 proximate the passageways 22. In this fully inserted position, the mating ends 42 of the contacts 26 are positioned in the passageways 22 of the housing 17 and the mounting portions 44 are positioned in the passageways 27 of the insert 19.

As the insertion of the contacts 26 occurs, the projections 49 engage the retention legs 38 of the resilient retention and contact projections 36. Continued insertion causes the projections 49 to elastically displace the retention legs 38 toward the wall of the passageway 27. As the projections 49 approach the rear wall 25 of the housing 17, the projections 49 move past the free ends of the retention legs 38 allowing the retention legs 38 to resiliently return toward their unstressed position. In this position, the locking shoulders 40 at the free ends of the retention legs 38 are positioned proximate to or in engagement with the mounting portions 44 of the contacts. In this position, the locking shoulders 40 are positioned proximate to or in engagement with the shoulders 46 of the projections 49, allowing the locking shoulders 40 of the retention legs 38 to cooperate with the shoulders 48 of the projections 49 to prevent the unwanted withdraw of the contacts 26 from the passageways 27.

With the contacts 26 properly inserted and retained in position, the retention legs 38 of the resilient retention and contact projections 36 of the grounding and retention member 18 are biased against, and maintained in contact with, the mounting portions 44 of the contacts 26. Due to the resilient characteristics of the resilient retention and contact projections 36, this bias is maintained as the contacts 26 are retained in the passageways 27, thereby providing a secure and maintainable electrical connection between the contacts 26 and the grounding and retention member 18.

As the grounding and retention member 18 are maintained in electrical engagement with the contacts 26 and the shell 21, an electrical pathway is provided from the contacts 26, through the grounding and retention member 18, and to the shell 21. This provides a reliable grounding path between the contacts 26 and the shell 21.

The grounding and retention member provides a cost effective, reliable grounding connection between the contacts and the shell of the connector. The grounding and retention member also retains the terminals in the connector in a cost effective, reliable manner. The present invention eliminates individual parts while ensuring that the contacts are properly maintained in the contact receiving passageway and properly grounded to the shell of the connector.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A grounding and retention member comprising:

a plate having openings positioned therein;

first contact and retention projections extending from proximate edges of the plate, the first contact and retention projections cooperate with a shell of the connector to provide an electrical connection between the plate and the shell of the connector; and second contact and retention projections extending from proximate edges of at least one of the openings, the second contact and retention projections cooperate to retain contacts in contact receiving passageways of a connector and to provide an electrical connection between the contacts and the plate, the second contact and retention projections having mounting legs, retention legs and U-shaped members attach the retention legs to the mounting legs, the retention legs being elastically bent or formed to extend into the opening a greater distance than mounting legs.

2. The grounding and retention member as recited in claim 1, wherein the openings have the same diameter.

3. The grounding and retention member as recited in claim 1, wherein respective opening of the openings have different diameters.

4. The grounding and retention member as recited in claim 1, wherein the first contact and retention projections are resilient members which are bent at an angle relative to a first surface of the plate.

5. The grounding and retention member as recited in claim 4, wherein multiple first contact and retention projections extend from each edge of the plate.

6. The grounding and retention member as recited in claim 1, wherein three second contacts and retention projections extend from proximate the edge of the openings.

7. A connector for housing a plurality of contacts therein, the connector comprising;

a non-conductive housing having a plurality of contact receiving passageways;

a conductive outer shell proximate the non-conductive housing;

a grounding and retention member having openings positioned therein, the openings being aligned with the contact receiving passageways, the grounding and retention member comprising;

first contact and retention projections extending from proximate edges of the grounding and retention member, the first contact and retention projections cooperate with the shell of the connector to provide an electrical connection between the grounding and retention member and the shell; and second contact and retention projections extending from proximate edges of the openings, the second contact and retention projections having mounting legs, retention legs and U-shaped members attach the retention legs to the mounting legs, the retention legs being elastically bent or formed to extend into the opening a greater distance than mounting legs, the second contact and retention projections cooperate to retain the contacts in the contact receiving passageways and to provide an electrical connection between the contacts and the grounding and retention member.

8. The connector as recited in claim 7, wherein three second contact and retention projections extend from proximate the edge of the openings.

9. The connector as recited in claim 8, wherein the first contact and retention projections are members which are bent at an angle relative to a first surface of the grounding and retention member.

10. The connector as recited in claim 9, wherein multiple first contact and retention projections extend from each edge of the grounding and retention member.

11. The connector as recited in claim 10, wherein the openings have the same diameter.

* * * * *